United States Patent [19]

Collins

[11] 3,973,162

[45] Aug. 3, 1976

[54] CATHODE SUPPORT MEANS FOR A CRT ELECTRON GENERATING ASSEMBLY

[75] Inventor: Floyd Keith Collins, Seneca Falls, N.Y.

[73] Assignee: GTE Sylvania Incorporated, Stamford, Conn.

[22] Filed: Sept. 2, 1975

[21] Appl. No.: 609,347

[52] U.S. Cl. ..... 313/417; 313/446

[51] Int. Cl.[2] ..... H01J 29/50; H01J 29/82

[58] Field of Search ..... 313/409, 417, 414, 446

[56] References Cited

UNITED STATES PATENTS

| | | | |
|---|---|---|---|
| 3,351,792 | 11/1967 | Kuryla | 313/451 X |
| 3,575,626 | 4/1971 | Blumenberg | 313/417 |
| 3,659,133 | 4/1972 | Tsuneta et al. | 313/417 |
| 3,816,789 | 6/1974 | Sawagata et al. | 313/417 X |
| 3,838,306 | 9/1974 | Jenne | 313/409 |

*Primary Examiner*—Robert Segal

*Attorney, Agent, or Firm*—Norman J. O'Malley; Frederick H. Rinn; Robert T. Orner

[57] ABSTRACT

An improvement in the means for supporting individually shielded cathodes is provided in a plural beam cathode ray tube electron generating assembly incorporating an in-line electron gun arrangement integrated by four spaced-apart longitudinal insulative rod-like supporting members. Each of the individual all-metal cathode assemblies is separately supported in a spatial manner apart from the related cup-like control electrode wherein a portion of the respective cathode assembly is oriented. The three cathode positioning members have discretely formed extremital portions embedded in the longitudinal supporting member to provide improved shielding and enhanced structural end-support for the in-line gun assembly.

4 Claims, 3 Drawing Figures

CATHODE SUPPORT MEANS FOR A CRT ELECTRON GENERATING ASSEMBLY

CROSS REFERENCE TO RELATED APPLICATION

This application contains matter disclosed but not claimed in a related United States Patent application filed concurrently herewith and assigned to the assignee of the present invention. This related application is Ser. No. 609,348, filed Sept. 2, 1975, Attorney's Docket D-8568.

BACKGROUND OF THE INVENTION

This invention relates to a plural beam cathode ray tube electron generating assembly and more particularly, to improved means for supporting shielded cathode assemblies in a multiple beam in-line electron gun construction.

In certain types of multiple gun cathode ray tube electron generating assemblies, wherein the guns are oriented in an in-line arrangement, it has been conventional practice to support the individual cathodes in annular ceramic discs which, in turn are concentrically positioned and retained within the cylinder of the respective cup-like control electrodes. It has been found that ceramic-supported cathodes evidence certain shortcomings relating to emission characteristics and manufacturability. Exact positioning of the cathode-to-control electrode spacing is difficult to consistently achieve and maintain by the conventional retaining means. Since the ceramics are formed as annular elements, wherein the individual cathodes are affixed by swage bead-like formations, engaging the upper and lower surfaces of the discs, there is a structurally dictated minimum to which the diameter of the apertured ceramic may be reduced. Thus, miniaturization of electron gun assemblies employing ceramic means for supporting the cathodes is limited by the required dimensioning of the ceramic support elements incorporated therein. Furthermore, such construction does not readily lend itself to the utilization of shielded cathode assemblies within the control electrode cup-like structures.

OBJECTS AND SUMMARY OF THE INVENTION

It is an object of the invention to reduce the aforementioned disadvantages evidenced in a plural beam in-line cathode ray tube electron generating assembly. Another object is to provide ruggedized end-structural support means for the in-line electron generating assembly. A further object is to effect improved cathode shielding in an in-line assembly.

The invention relates to improved means for supporting the respective cathode structures within the in-line electron gun assembly wherein the prior cathode ceramic support means are eliminated and all-metal shielded cathode assemblies are advantageously utilized. Shielded all-metal cathode assemblies of this type are disclosed by A. T. Kuryla in U.S. Pat. No. 3,351,792, which is assigned to the assignee of the present invention. In accordance with the present invention, similar first and third cathode positioning members are employed for supporting each of the first and third shielded cathode assemblies of the in-line arrangement. Each of the first and third positioning members has a planar base section with an aperture therethrough of a size to accommodate placement and affixation of a respective shielded all-metal cathode assembly. Each of the planar sections has two parallel traverse bends therein, one on either side of the central plane of orientation of the inline guns. From these traverse bends, opposed side members extend in a manner substantially perpendicular thereto as skirt-like walls. Each wall has an extremital portion with a configurated terminus outstanding therefrom in a manner substantially normal thereto from a vertical transverse bend therein which is parallel with the central plane of the guns. The two vertical transverse bends in each of the positioning members are in a common plane, which is in substantially right angular relationship with the central plane, wherealong the termini extend outwardly in an opposed manner and are thence embedded in the several glass support members integrating the electron generating assembly.

The center cathode positioning member for supporting the center shielded cathode assembly likewise has a planar base section with an aperture therethrough of a size to accommodate placement and affixation of the center shielded cathode assembly therein. The center planar section is oriented in a plane substantially common with that of the planar base sections of the first and third cathode positioning members. Similarly, the center planar section likewise has two parallel transverse bends therein from which opposed side members extend in a manner substantially perpendicular thereto as skirt-like walls. Each of these walls has two extremital portions with configurated termini outstanding from either end thereof, in a manner substantially normal to the respective walls, from two vertical transverse bends therein that are parallel to the central plane of the guns. Hence, each end of the center positioning member has two of the aforementioned extremital portions emanating therefrom in an opposed manner in a common plane at substantially right angular relationship to the central plane. The resultant four outwardly extending configurated termini are embedded in the four support members of the electron generating assembly. Thus, improved cathode shielding and enhanced structural end-support is effected in the in-line electron gun assembly.

DESCRIPTION OF THE PREFERRED EMBODIMENT

Figure 1:
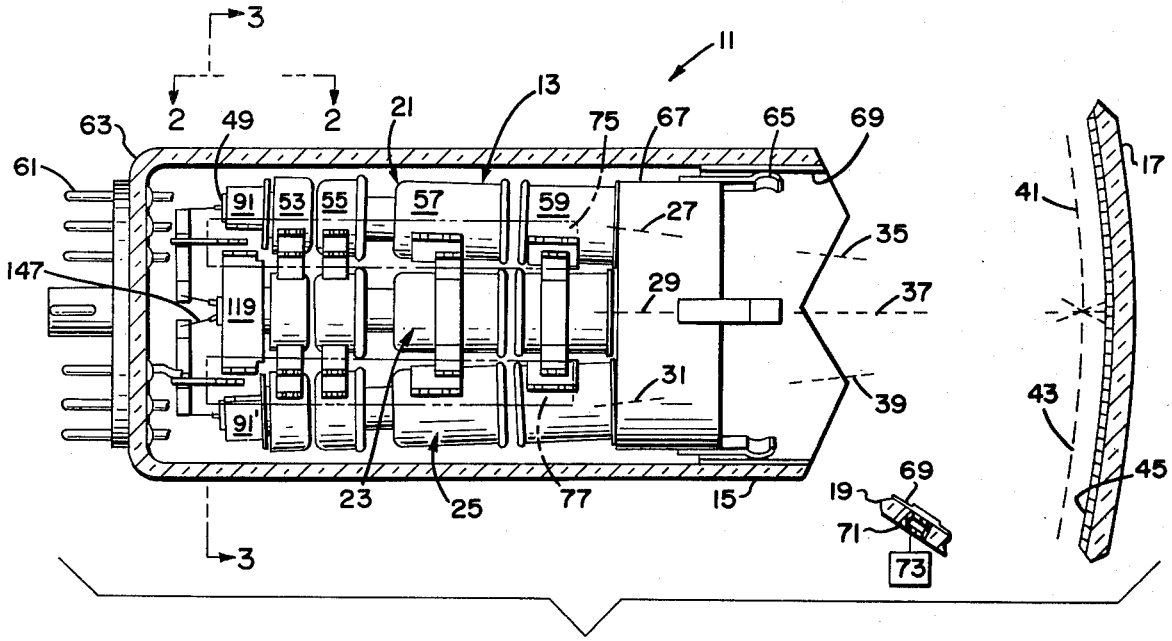
FIG. 1 is a partial plan view illustrating the neck section, the electron generating assembly and a screen portion of an inline plural beam color cathode ray tube embodying the features of the invention.

For a better understanding of the present invention, together with other and further objects, advantages and capabilities thereof, reference is made to the following specification and appended claims in connection with the aforedescribed drawings.

With reference to the Figures, there are shown pertinent portions of a typical plural beam color cathode ray tube 11 embodying an electron generating assembly 13 employing an in-line arrangement of related electron guns. Such tubes are of the type conventionally utilized for the reproduction of color imagery in television display applications. The neck portion 15 of the glass envelope is suitably connected to an oppositely disposed viewing panel or faceplate portion 17 by an intermediate funnel portion 19, which is not detailed. Within the neck portion there is positioned a plural beam electron generating assembly 13 having three individual multi-electrode gun structures 21, 23 and 25, oriented in an in-line arrangement, whereof the center or second electron gun 23 is flanked by first 21 and third 25 guns; the individual axes 27, 29 and 31 of the three guns being oriented in a common central plane "*a*". Each gun in the assembly generates an individual beam of controlled electrons 35, 37 and 39, which are directed to converge at the plane of the aperture mask 41, whereupon the individual beams pass through the holes or apertures 43 therein to impinge discrete areas of the patterned phosphor screen 45 disposed upon the interior surface of the viewing panel 17 of the tube. The impingement of the controlled electrons effects luminescent excitation of selected areas of the screen, such being manifest as a visual display of color imagery.

Each of the individual electron guns 21, 23 and 25 is formed of a plurality of related electrodes. In considering one gun 21 as an example, the gun integration is comprised of a cathode assembly structure 47, which includes a cathode sleeve 49 and a cathode shielding eyelet 51, a first or control electrode 53, and second 55, third 57, and fourth 59 electrodes respectively. The respective electrical connections are made to all electrodes, except the terminal electrode, by a plurality of connectors 61 hermetically sealed in the base end 63 of the tube. For purposes of clarity, the individual internal electrode connections are not shown. In the case of the terminal electrode 59, electrical connection is made through a plurality of snubber elements 65 which are affixed to the terminal cup assembly 67, thereby effecting electrical contact with the internal conductive coating 69 disposed on the upper part of the neck portion and extending therefrom over the interior surface of the funnel 19, a section of which is shown. A high voltage connective means 71 hermetically traverses the aforementioned funnel portion to connect the internal conductive coating 69 to an external source of potential 73.

As shown in the Figures, the electron generating assembly 13 utilizes four spatially related longitudinal insulative rodlike members, 75, 77, 79 and 81, formed of a material such as glass, which are arrnaged in pairs, 75, 77, and 79, 81, on either side of the central plane "*a*" of the in-line gun arrangement wherein configurated attachment means, such as 82, are embedded to support the plurality of related electrode elements forming each of the in-line gun structures.

Figure 2:
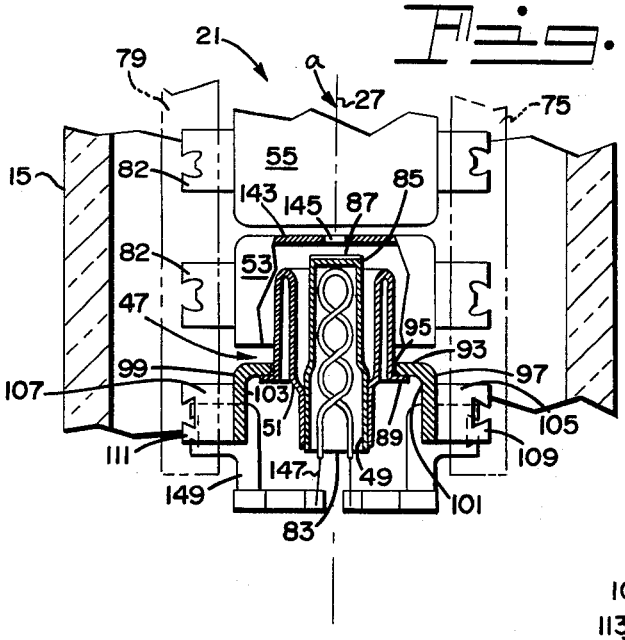
FIG. 2 is an enlarged sectional view of a portion of the electron generating assembly taken along the plane 2-2 of FIG. 1.
Figure 3:
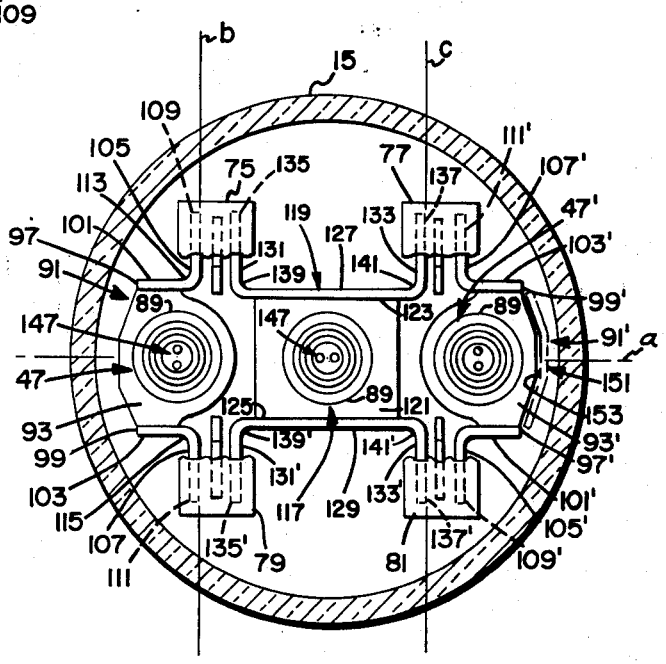
FIG. 3 is an enlarged plan view of a section of the in-line electron generating assembly taken along the plane 3-3 of FIG. 1 showing the structural details of the invention.

With particular reference to FIGS. 2 and 3, the cylindrical cathode sleeve 49 has an open end 83 and an oppositely closed end 85, the outer surface of which has a layer of electron emissive material 87 disposed thereon. The open end of the sleeve is affixed in a compatibly dimensioned portion of a cathode shielding eyelet 51 which is a dual-dimensioned structure having an overall length shorter than that of the cathode sleeve 49. Embodiments of this type of eyelet are disclosed in the previously mentioned U.S. Pat. No. 3,351,792 which was issued to A. T. Kuryla. In the present instance, as shown in FIG. 2, the exemplary dual-dimensioned cathode shielding eyelet 51 has a substantially cylindrical upper portion formed as a dual wall structure fashioned from an inner wall doubled back on itself in an outward inverse manner to form a related outer wall. The extremital portion of the outer wall is formed in an outstanding manner to provide a substantially circular seating projection 89 oriented intermediate to the open ends of the eyelet.

The invention relates to improved means for supporting the respective all-metal shielded cathode assemblies 47 in an integrated in-line plural gun assembly. Substantially similarly formed first and third cathode positioning members 91 and 91' are provided for supporting each of the first 47 and third 47' shielded cathode assemblies. These first and third positioning members each have a substantially planar base section 93 and 93' with an aperture 95 and 95' therethrough of a size to accommodate placement and affixation of the seating portion 89 and 89' of a respective shielded cathode assembly therein. Each planar section has two edge-related parallel transverse bends therein, 97, 99 and 97', 99'; one on either side of the central plane "*a*". From these transverse bends opposed side members, 101, 103 and 101', 103', extend in a manner substantially perpendicular thereto as skirt-like walls. Each of these opposed walls has an extremital portion, 105, 107 and 105' and 107', with a configurated terminus, 109, 111 and 109', 111', which is outstanding from the respective wall in a manner substantially normal thereto from a respective vertical transverse bend 113 and 115 therein which is parallel with the central plane "*a*". The two vertical transverse bends 113 and 115 in each positioning member are in a common plane "*b*" which is in a substantially right angular relationship with the central plane "*a*". Thus, the respective termini, 109 and 111 for example, extend in an opposed outward manner and are embedded in the respective member of each pair of insulative support members.

The center shielded cathode assembly 117 is supported by a center cathode positioning member 119 formed to have a planar base section 121 with an aperture therethrough of a size to accommodate placement and affixation of the cathode assembly. The center planar section is oriented in a plane substantially common with that of the planar base sections 93 and 93' of the first and third positioning members 91 and 91'. Structurally, the center planar section has two parallel transverse bends 123 and 125 formed therein, one on either side of the central plane "*a*". Opposed side members 127 and 129 extend from these bends in a manner perpendicular to the planar section as skirt-like walls. Each of these walls 127 and 129 has two extremital portions, 131, 131' and 133, 133' with configurated termini, 135, 135' and 137, 137', outstanding from either end thereof in a manner substantially normal to the respective wall from two vertical transverse bends, 139, 139' and 141, 141', therein which are parallel to the central plane "*a*". Such angular structure imparts ruggedness to the member. Each end of the center positioning member 119 has two of the aforementioned extremital portions, such as 137 and 137', emanating therefrom in an opposed manner in a common plane "*c*" with substantially right angular relationship to the central plane "*a*". The four extremital portions, 131, 131', 133 and 133', extending from the four corner-oriented vertical transverse bends 139, 139', 141, 141', effect a ruggedized substantially H-shaped structure. The four configurated termini, 135, 135', 137 and 137', extending therefrom are embedded in each of the four longitudinal support members 75, 77, 79 and 81. Thus, there is provided an enhanced structural end-support means for imparting improved ruggedness to the plural gun electron generating assembly 13.

The skirt-like side members, 101, 101', 103, 103', 127 and 129, of the three cathode positioning members, 91, 91' and 119, are substantially co-extensive with the bottom 83 of the shielded cathode assembly. Furthermore, these side members of the three cathode positioning members, being oriented in common parallel planes, provide cooperating shielding effects at the rear of the electron gun assembly structure, whereby sublimations emanating from the open cathodes are substantially confined to that region of the gun assembly.

By way of example, each of the control grids, such as 53, in the in-line electron gun structure 21 is substantially shaped as a cup-like member having a cylindrical sidewall portion with an open end lip therearound and an oppositely disposed closed end 143 having a centrally defined aperture 145 therein. This electrode, being inverted and separately affixed to the respective support members, 75 and 79, is telescopingly positioned over the shielded cathode assembly 47 in a manner to provide spaced co-axial alignment between the electrode aperture 145 and the end wall 85 of the cathode sleeve 49. By such orientation, the cathode is effectively shielded by the conjunctive overlapping of the sidewalls of the shielding eyelet and the control grid, and as a result, any dispersion of cathode sublimation material is controlled or confined to non-vulnerable areas. Thus, there is provided optimum shielding of the respective cathode sleeves from the proximal insulative longitudinal support rods thereby inhibiting the formation of deleterious electrical leakage films thereon that may be resultant from sublimation of material from the cathode structure.

A conventional heating element 147 is positioned within each of the cathode sleeves through the open end 83 thereof, to provide the necessary operational temperature thereto. These individual heating elements are separately supported by heater support means 149 embedded in the longitudinal support rods.

It is within the meaning of the concept to incorporate skirt-like end walls 151 with each of the first and third cathode positioning members 91 and 91', as exemplarily phantomed in FIG. 3 relative to member 91'. Such end walls, which provide additional shielding and structural support, may be expediently formed as downstanding appendages extending from the outer edge 153 of the respective cathode positioning members.

Thus, there is provided improved means for supporting allmetal shielded cathode assemblies in a multiple beam in-line electron gun construction. The improvement provides ruggedized structural end support means for the in-line gun assembly, and additionally effects improved cathode shielding therefor.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a plural beam cathode ray tube electron generating assembly incorporating an in-line arrangement of a center electron gun flanked by first and third electron guns, each having an individual axis oriented in a common central plane, said assembly utilizing four spatially related longitudinal glass rod-like members arranged as pairs on either side of said central plane to support the plurality of electrode elements forming each of said in-line electron guns, wherein each gun includes an apertured cup-like control electrode and a separate spatially associated metallic construction embodying a shielded cathode assembly, said improvement relating to means for supporting the respective shielded cathode assemblies in said in-line electron guns comprising: substantially similar first and third cathode positioning members for supporting each of said first and third shielded cathode assemblies, said first and third positioning members each having a substantially planar base section with an aperture therethrough of a size to accommodate placement and affixation of a respective shielded cathode assembly therein, each planar section having an outer edge and two parallel transverse bends therein one on either side of said central plane wherefrom opposed side members extend in a manner substantially perpendicular thereto as skirt-like walls, each of said walls having an extremital portion with a configurated terminus outstanding therefrom in a manner substantially normal thereto from a vertical transverse bend therein parallel with said central plane, said vertical transverse bends in each positioning member being in a common plane in substantially right angular relationship with said central plane wherealong said termini extend outwardly in an opposed manner being embedded in a respective member of each pair of said glass support members; and a center cathode positioning member for supporting said center shielded cathode assembly, said center cathode positioning member having a substantially planar base section with an aperture therethrough of a size to accommodate placement and affixation of said center shielded cathode assembly therein, said center planar section being oriented in a plane substantially common with said planar base sections of said first and third positioning members, said center planar section having two parallel transverse bends therein one on either side of said central plane wherefrom opposed side members extend in a manner perpendicular thereto as skirt-like walls, each of said walls having two extremital portions with configured termini outstanding from either end thereof in a manner substantially normal thereto from two vertical transverse bends therein parallel to said central plane, each end of said central positioning member having two of said extremital portions emanating therefrom in an opposed manner in a common plane at substantially right angular relationship with said central plane, said four extending configurated termini being embedded in the four support members of said electron generating assembly; the respective skirt-like side members of said three cathode positioning members being oriented in common parallel planes with said in-line gun arrangement to provide cooperating side shielding effects at the rear of said electron gun assembly.

2. The improvement in the in-line plural beam cathode ray tube electron generating assembly according to claim 1 wherein said skirt-like side members of said three cathode positioning members are substantially co-extensive with the bottom of the shielded cathode assembly.

3. The improvement in the in-line plural beam cathode ray tube electron generating assembly according to claim 1 wherein the four vertical transverse bends in said center cathode positioning member effect a ruggedized substantially H-shaped structure which being embedded in each of said four support members provides enhanced end-structural support means for said electron generating assembly.

4. The improvement in the in-line plural beam cathode ray tube electron generating assembly according to claim 1 wherein each of said first and third cathode positioning members has a skirt-like end wall associated with the outer edge thereof to provide additional shielding and enhanced structural support for said electron generating assembly.

* * * * *